US008408248B2

(12) United States Patent
Geist

(10) Patent No.: US 8,408,248 B2
(45) Date of Patent: Apr. 2, 2013

(54) ROTARY VALVE FOR THE CONTROL OF STEAM THROUGHPUT IN A STEAM TURBINE

(75) Inventor: Richard Geist, Lauf (DE)

(73) Assignee: Siemens Aktiengesellschaft, München (DE)

( * ) Notice: Subject to any disclaimer, the term of this patent is extended or adjusted under 35 U.S.C. 154(b) by 449 days.

(21) Appl. No.: 12/668,072

(22) PCT Filed: Jul. 9, 2008

(86) PCT No.: PCT/EP2008/058883

§ 371 (c)(1),
(2), (4) Date: Jan. 7, 2010

(87) PCT Pub. No.: WO2009/007383

PCT Pub. Date: Jan. 15, 2009

(65) Prior Publication Data

US 2010/0189550 A1 Jul. 29, 2010

(30) Foreign Application Priority Data

Jul. 10, 2007 (EP) ..... 07013509

(51) Int. Cl.
*F01D 1/30* (2006.01)

(52) U.S. Cl. ..... 137/625.31; 415/159

(58) Field of Classification Search ..... 137/625.3, 137/625.31; 415/159
See application file for complete search history.

(56) References Cited

U.S. PATENT DOCUMENTS

| | | | | |
|---|---|---|---|---|
| 707,727 | A * | 8/1902 | Schulz | 415/149.2 |
| 867,611 | A * | 10/1907 | Schulz | 415/149.2 |
| 2,666,618 | A * | 1/1954 | Jaquith | 415/159 |
| 4,526,199 | A * | 7/1985 | Heitmann | 137/625.31 |
| 5,157,779 | A | 10/1992 | Lemmo | |
| 5,409,351 | A * | 4/1995 | Geist | 415/159 |
| 5,799,927 | A * | 9/1998 | Geist | 251/212 |
| 7,097,421 | B2 * | 8/2006 | Swanson et al. | 415/127 |
| 2007/0255579 | A1 | 11/2007 | Boland | |

FOREIGN PATENT DOCUMENTS

| | | | |
|---|---|---|---|
| BE | 501076 | A | 4/1952 |
| DE | 4238550 | A1 | 5/1994 |
| DE | 19620949 | A1 | 11/1997 |
| FR | 362019 | A | 12/1905 |
| GB | 191301187 | A | 6/1913 |
| SE | 75786 | C | 11/1932 |
| SU | 802562 | A1 | 2/1981 |
| WO | WO 9502448 | A1 | 1/1995 |

* cited by examiner

*Primary Examiner* — John Fox

(57) ABSTRACT

A rotary valve for the control of the steam throughput in a steam turbine is provided. The rotary valve includes an immovable fixed ring and a rotary ring which is arranged concentrically and rotatably on the fixed ring. The rotary valve is equipped with control profiles including profiled heads and profiled ends, between which control slots are formed, wherein the profiled heads are arranged on the rotary ring, and the profiled ends are arranged on the fixed ring. In the contact plane between rotary ring and fixed ring, the width of the control slot is equal to the width of the control profile. Blades are arranged between the profiled ends in the fixed ring, the blades dividing each control slot of the fixed ring into two partial slots.

7 Claims, 2 Drawing Sheets

ROTARY VALVE FOR THE CONTROL OF STEAM THROUGHPUT IN A STEAM TURBINE

CROSS REFERENCE TO RELATED APPLICATIONS

This application is the US National Stage of International Application No. PCT/EP2008/058883, filed Jul. 9, 2008 and claims the benefit thereof. The International Application claims the benefits of European Patent Office application No. 07013509.0 EP filed Jul. 10, 2007, both of the applications are incorporated by reference herein in their entirety.

FIELD OF INVENTION

The invention relates to a rotary valve for controlling the steam throughput in a steam turbine having the features of the preamble of the claims.

BACKGROUND OF INVENTION

Rotary valves embodied as axial or radial rotary valves are used to control the steam throughput in a steam turbine. With the immovable fixed ring and the rotary ring which is arranged concentrically and rotatably on said fixed ring, the angular position of which can be changed by a servomotor, it is possible to open or close the control slots provided in the two rings to a greater or lesser extent. Compared with the valves used otherwise in steam turbine construction for controlling steam removal, rotary valves of this type are embodied relatively simply and still also feature a few other advantages.

A generic rotary valve for a steam turbine is known from DE 19 620 949 A1. The known rotary valve only achieves the best degree of efficiency for the steam turbine when fully open, since in this position the control slots are optimally passed through. If the rotary valve moves in the closing direction, by the profile heads in the rotary ring being moved upstream of the control slots in the fixed ring, strong turbulences result in the partially closed state of the rotary valve on the edges of the profile heads and the profile ends. As a result of such turbulences, the degree of efficiency of the steam turbine is significantly worse in the case of a partial load.

SUMMARY OF INVENTION

The object underlying the invention is to configure the generic rotary valve such that the degree of efficiency of the steam turbine is improved in the partial load range.

The object is achieved in accordance with the invention with a generic rotary valve by the characterizing features of the claims. Advantageous embodiments of the invention form the subject matter of the subclaims.

With the inventive rotary valve, the profile heads of the rotary ring can release or cover both partial slots of the control slot. It is also possible for the profile heads of the rotary ring, when the rotary valve is half open, to close one of the partial slots respectively, while the other partial slot is opened. The half of the partial slot is thus opened and can be passed through optimally and undisturbed. A high degree of efficiency is also achieved in this way with a half load and the reduction in the degree of efficiency is less significantly influenced with the other partial loads.

BRIEF DESCRIPTION OF THE DRAWINGS

An exemplary embodiment of the invention is shown in the drawing and is explained in more detail, in which.

DETAILED DESCRIPTION OF INVENTION

Figure 2:
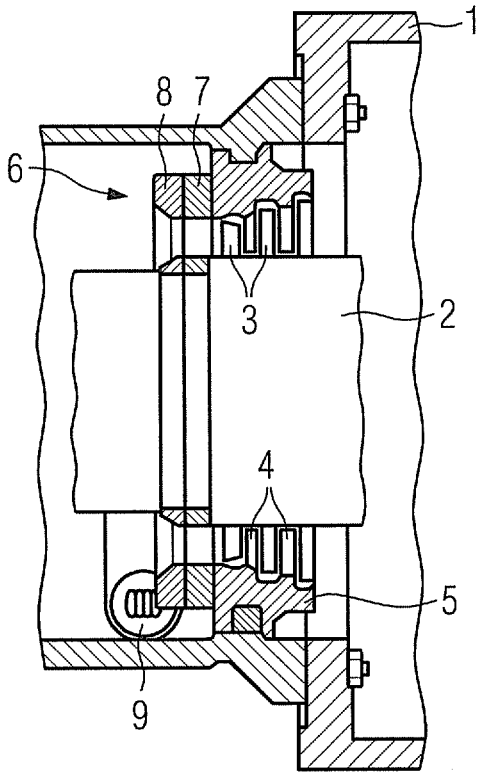
FIG. 2 shows the longitudinal section through a subarea of a steam turbine with an axial rotary valve and FIGS. 3 to 5 show the partial unrolling of the rotary valve, namely in the open position of the rotary valve (FIG. 3), in the closed position of the rotary valve (FIG. 4) and in the half-open position of the rotary valve (FIG. 5).

Only the medium pressure part of a multistage steam turbine is shown in FIG. 2. The steam turbine contains a turbine housing 1, in which a turbine rotor 2 rotates. The turbine rotor 2 is provided with rotor blades 3. Stationary guide vanes 4, which are suspended on a guide vane carrier 5 connected to the turbine housing 1 are located between the rotor blades 3.

Figure 1:
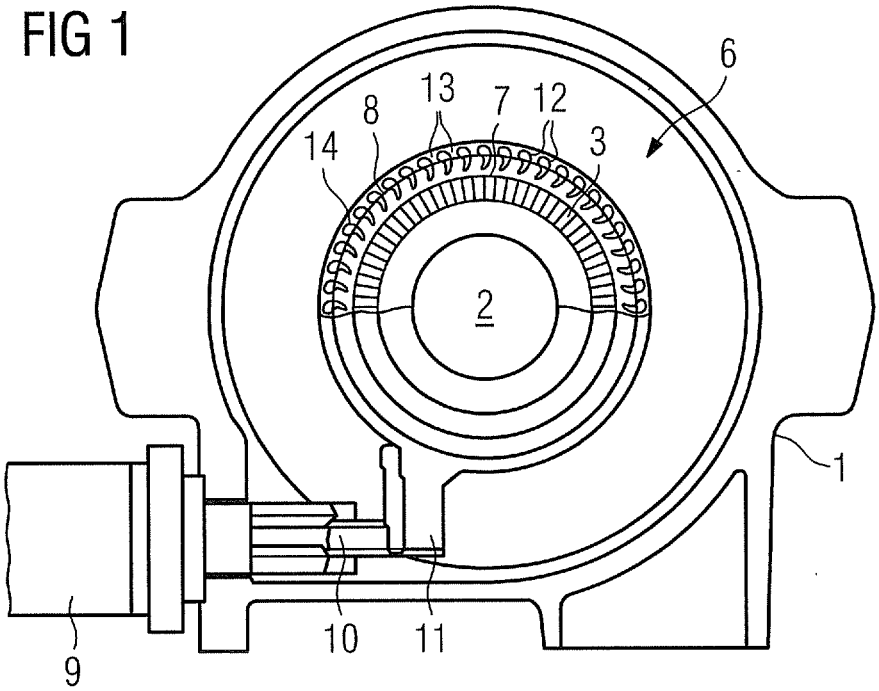
FIG. 1 shows the cross-section through a steam turbine with a radial rotary valve.

A rotary valve 6 embodied as an axial rotary valve for controlling the steam throughput through the steam turbine is arranged upstream of the flow channel of the steam turbine which is formed by the rotor blades 3 and the guide vanes 4 (FIG. 2). In a corresponding arrangement within the steam turbine, the configuration of the subsequently described rotary valve can also be applied to a radial rotary valve, as shown in FIG. 1.

The rotary valve 6 comprises a fixed ring 7 and a rotary ring 8. The fixed ring 7 is fixedly connected to the guide vane carrier 5. The rotary ring 8 is arranged concentrically and rotatably on the fixed ring 7. A servo motor 9 is used to rotatably adjust the rotary ring 8 compared with the fixed ring 7. The servo motor 9 used to adjust the radial rotary ring shown in FIG. 1 engages with the rotary ring 8 across a hinged spindle 10 and a hinged lever 11. The rotary ring 8 is rotated by way of the lift of the servo motor 9.

The rotary valve 6 is provided with control profiles 12, between which control slots 13 are formed. In the case of the axial rotary valve, the control slots 13 are disposed coaxially relative to the flow channel of the steam turbine and are shown completely open in FIG. 3. The control profiles 12 are cut and each comprises a profile head 12.1 and a profile end 12.2. The profile heads 12.1 and the profile ends 12.2 are arranged in the rotary ring 9 and in the fixed ring 7 respectively. When the rotary valve 6 is completely open (FIG. 3), the profile heads 12.1 and the profile ends 12.2 rest in a form fit fashion one above the other and as a result of their aerodynamically optimized form, only form a relatively small resistance for the steam flowing toward the rotor blades 3 of the turbine rotor 2 in the direction of arrow.

The control profiles 12 and the control slots 13 are attuned to one another such that in the contact plane between the rotary ring 8 and fixed ring 7, the width of the control profile 12 is equal to the width of the control slots 13. Aerodynamically shaped blades 14 are arranged between the profile ends 12.2 of the control profiles 12 within the fixed ring 7. The blades 14 divide the control slots 13 between two profile ends 12.2 into two partial slots 13.1, 13.2 in each instance. The blades 14 are preferably arranged centrally within the control slot 13 so that two equally wide partial slots 13.1, 13.2 are formed in each instance.

Such an arrangement is selected if the partial load point lies at approximately 50% of the full load. The blades 14 can also be arranged outside the center of the control slot 13, if the desired partial load point is not at 50%.

Figure 3:
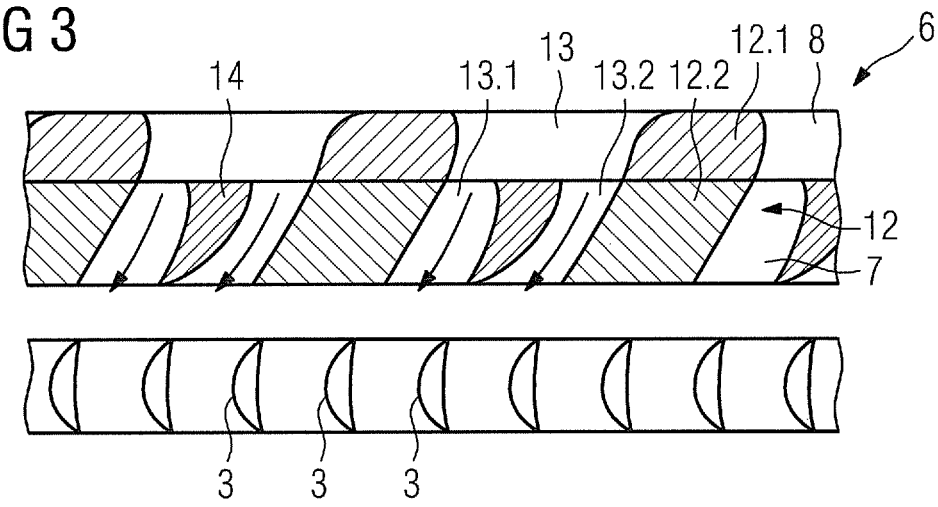
Figure 4:
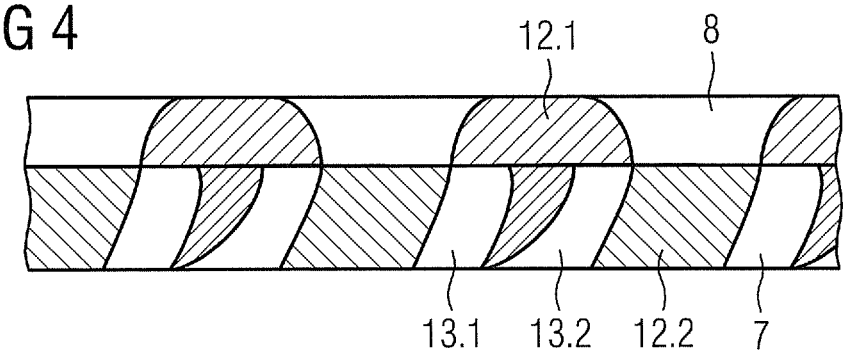
Figure 5:
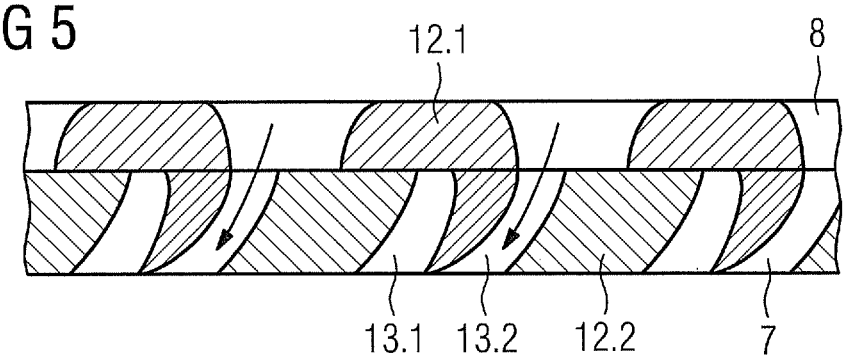

The meaning behind the partial slots 13.1, 13.2 formed by the blades 14 is clear from FIG. 5 in conjunction with FIGS. 3 and 4. In FIG. 3, the rotary ring 8 is rotated relative to the fixed ring 7 to such a degree that the profile heads 12.1 rest in a form fit fashion on the profile ends 12.2 and the control profiles 12 are released. Steam can pass through the control slots 13 in an optimum and undisturbed fashion.

Rotating the rotary ring 8 relative to the fixed ring 7 enables the profile heads 12.1 to rest on the edges of the profile ends 12.2 in a form fit fashion and the control slots 13 with the partial slots 13.1, 13.2 to be completely covered and blocks a passage of steam (FIG. 4).

According to FIG. 5, with a half load, the rotary ring 8 is rotated relative to the fixed ring 7 to such a degree that each profile head 12.1 rests on the profile ends 12.1 in a partially form fit fashion and covers a partial slot 13.1 and releases the other partial slot 13.2. In such a position, steam passes through the opened partial slot 13.2 once again in an optimal and undisturbed fashion.

The invention claimed is:

1. A rotary valve for controlling the steam throughput in a steam turbine, comprising:

an immovable fixed ring; and a rotary ring which is arranged concentrically and rotatably on the fixed ring, wherein an angular position of the fixed ring may be changed by a servo motor, wherein the rotary valve is provided with a plurality of control profiles comprising a plurality of profile heads and a plurality of profile ends between which a plurality of control slots are formed, wherein the plurality of profile heads are arranged on the rotary ring and the plurality of profile ends are arranged on the fixed ring, wherein in a contact plane between the rotary ring and the fixed ring, the width of each control slot is equal to the width of each profile head, and the width of each profile head is equal to the width of the respective profile end, wherein a plurality of blades are arranged between the plurality of profile ends in the fixed ring, the plurality of blades dividing each control slot of the fixed ring into two partial slots, and wherein the rotary ring is operable to bring profile heads into position for blocking and for releasing the two partial slots with respect to passage of steam therethrough.

2. The rotary valve as claimed in claim 1 , wherein the plurality of blades are arranged centrally within the control slots.

3. The rotary valve as claimed in claim 2, wherein the plurality of centrally arranged blades form equally sized partial slots.

4. The rotary valve as claimed in claim 1, wherein the plurality of blades are arranged eccentrically between the profile ends.

5. The rotary valve as claimed in claim 1, wherein in a fully open position, the profile heads are positioned to release both of the two partial slots.

6. The rotary valve as claimed in claim 1, wherein in a half-open position, the profile heads are positioned to release one of the two partial slots, and blocking the other partial slot.

7. The rotary valve as claimed in claim 1, wherein in a closed position, the profile heads are positioned to block both of the tow partial slots.

* * * * *